US007102594B2

(12) United States Patent
Fan

(10) Patent No.: US 7,102,594 B2
(45) Date of Patent: Sep. 5, 2006

(54) STACKED OPTICAL FIBER SCREEN

(76) Inventor: Wen-Qin Fan, Building 3, No. 5, Jian Bo Ting Yuan, Cheng Gong Li, Tou Fen Zhen, Mia Li Xian (TW)

( * ) Notice: Subject to any disclaimer, the term of this patent is extended or adjusted under 35 U.S.C. 154(b) by 410 days.

(21) Appl. No.: 10/485,778

(22) PCT Filed: Aug. 14, 2002

(86) PCT No.: PCT/CN02/00560

§ 371 (c)(1),
(2), (4) Date: Feb. 2, 2004

(87) PCT Pub. No.: WO2004/017282

PCT Pub. Date: Feb. 26, 2004

(65) Prior Publication Data

US 2004/0233123 A1 Nov. 25, 2004

(51) Int. Cl.
*G09G 5/00* (2006.01)

(52) U.S. Cl. ..... 345/6; 345/1.3

(58) Field of Classification Search ..... 345/1.1–1.3, 345/4–6, 9, 76–90; 349/73–74
See application file for complete search history.

(56) References Cited

U.S. PATENT DOCUMENTS 3,822,938 A * 7/1974 Hirsch ..... 353/121
2002/0033911 A1* 3/2002 Ishida et al. ..... 349/74

* cited by examiner

*Primary Examiner*—Ricardo Osorio
*Assistant Examiner*—Mansour M. Said
(74) *Attorney, Agent, or Firm*—Dellett & Walters

(57) ABSTRACT

An optical display has multiple display units overlapped on top of one another. Each display unit includes light holes defined in a front face of the display unit for emission of light, multiple first bosses formed on a top face of the display unit and multiple first grooves defined in a bottom face of the display unit such that two adjacent display units are able to be combined with one another via the extension of the first bosses from one display unit into the first grooves of the other display unit.

7 Claims, 11 Drawing Sheets

STACKED OPTICAL FIBER SCREEN

BACKGROUND OF THE INVENTION

1. Field of the Invention

The present invention relates to an optical display, and more particularly to an optical display with multiple overlapped display units so that the optical display is able to be formed into any desired shape.

2. Description of Related Art

Commercial advertisements often use multiple televisions combined together to form a so-called "TV wall" to display a message to attract customers' attention. The resolution of this kind of displaying mechanism is determined by the resolution of each of the TV sets. However, due to the frames of each of the TVs, the customers are not able to see clearly the presenting pictures. To overcome the shortcoming, a display using optical fibers as the medium to transmit the light to form the entire picture is introduced to the market. Because of the massive amount of the optical fibers, the resolution of this kind of display is a great improvement on the "TV wall". Still, due to the relatively large distance between two adjacent optical fibers, the quantity of light dots formed on the display to show a picture is small. As a consequence, although the resolution is improved when compared with the conventional TV wall, the resolution still has a lot of room to be enhanced.

To overcome the shortcomings, the present invention tends to provide an improved optical display to mitigate the aforementioned problems.

SUMMARY OF THE INVENTION

The primary objective of the present invention is to provide an improved optical display having multiple overlapped display units each closely connected to one another such that the resolution is enhanced.

Another objective of the present invention is that the optical display is able to be formed into any desired shape such that the user is able to have a custom-made display entirely fitted to the requirements.

Other objects, advantages and novel features of the invention will become more apparent from the following detailed description when taken in conjunction with the accompanying drawings.

DETAILED DESCRIPTION OF THE PREFERRED EMBODIMENT

Figure 1:
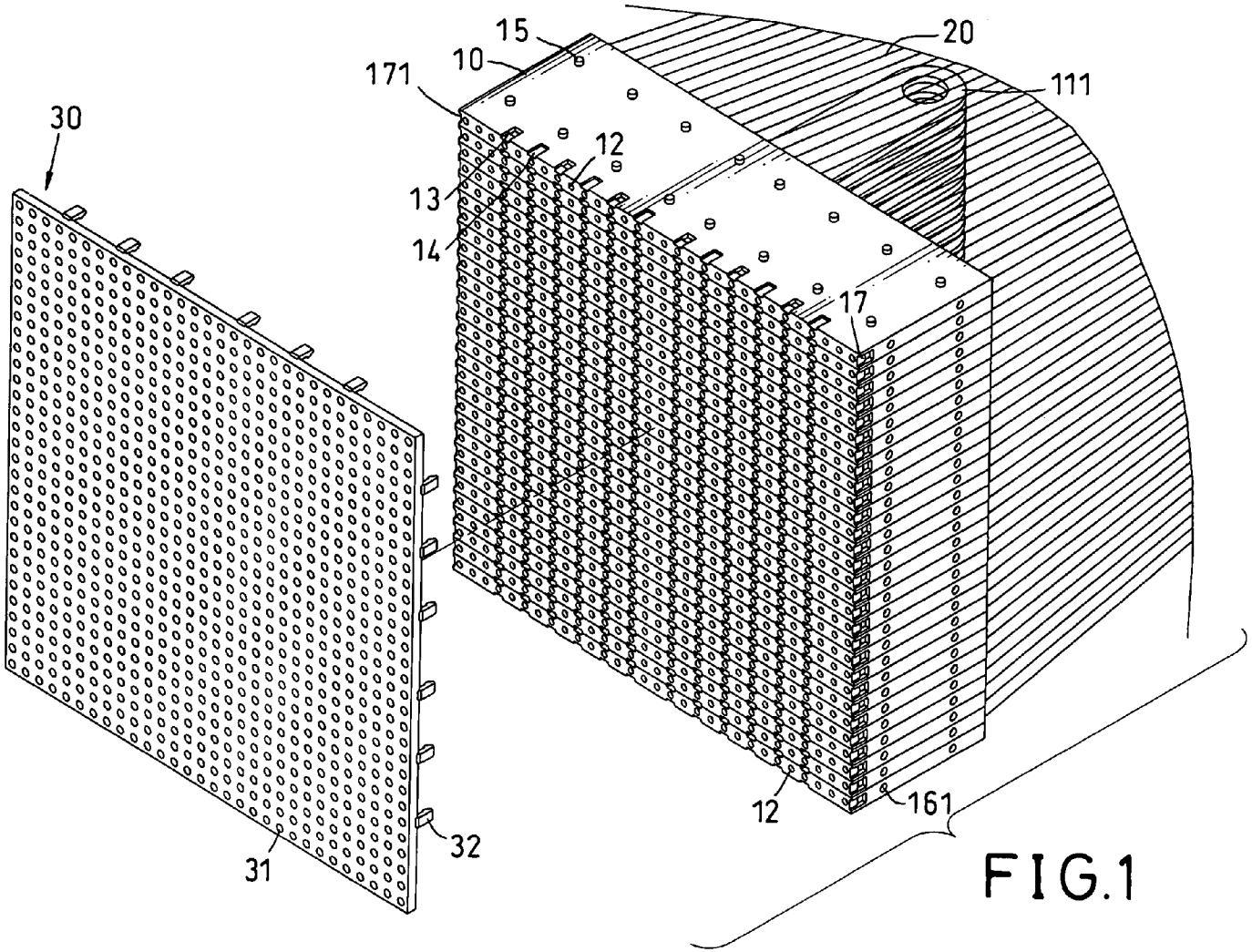
FIG. 1 is an exploded perspective view of the optical display of the present invention.

With reference to FIG. 1, an optical display in accordance with the present invention includes multiple display units (10) and a conducting board (30).

Figure 2:
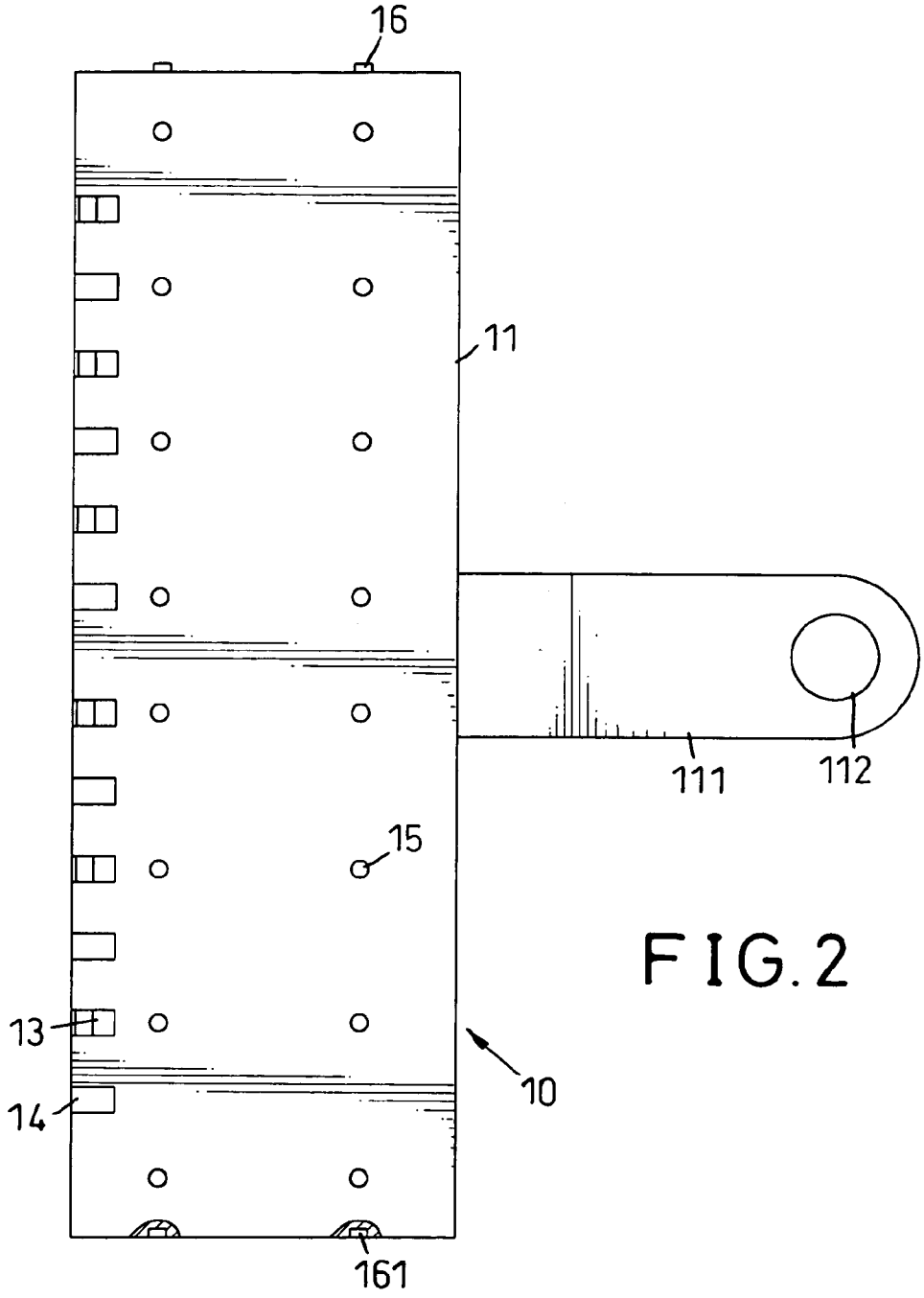
FIG. 2 is a top plan view of one display unit of the optical display of the present invention.
Figure 3:
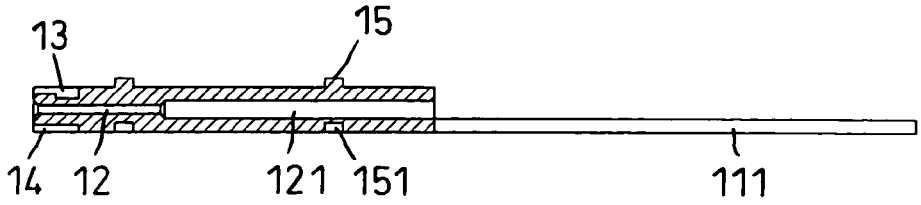
FIG. 3 is a cross sectional side view showing the internal structure of one display unit.
Figure 4:
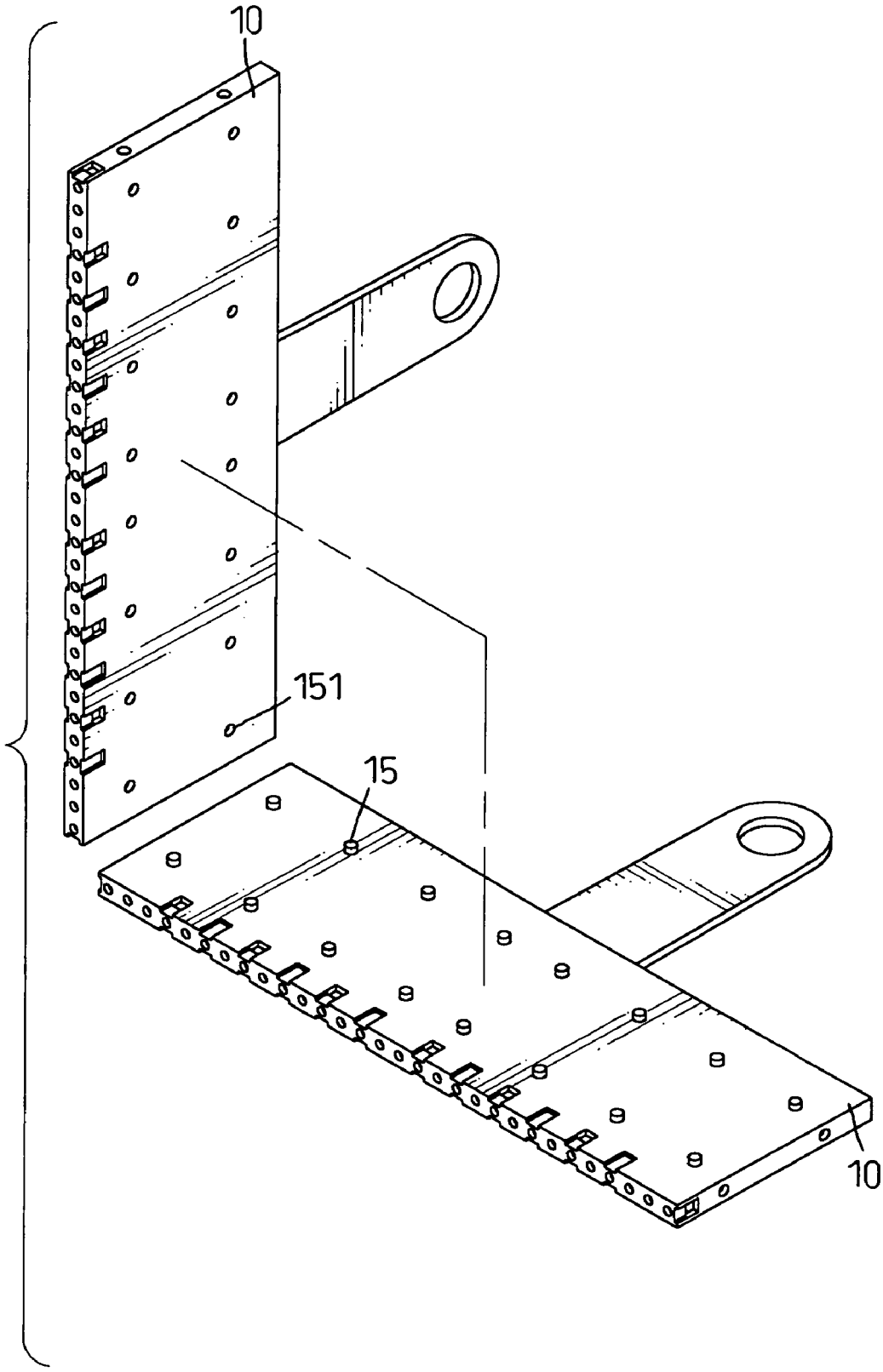
FIGS. 4–7 are perspective views showing different embodiments of the bosses formed on a top face of the display unit.
Figure 5:
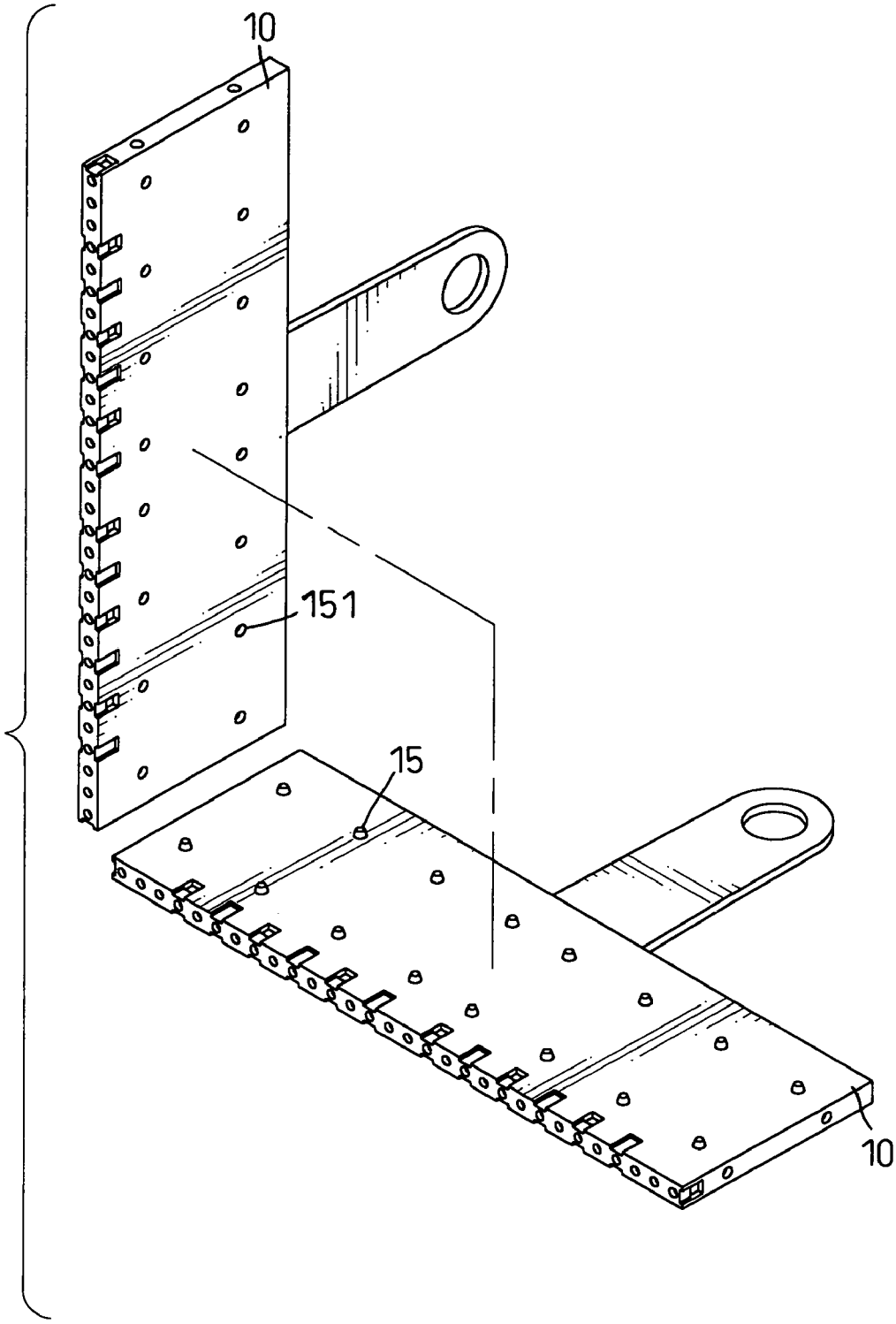
Figure 6:
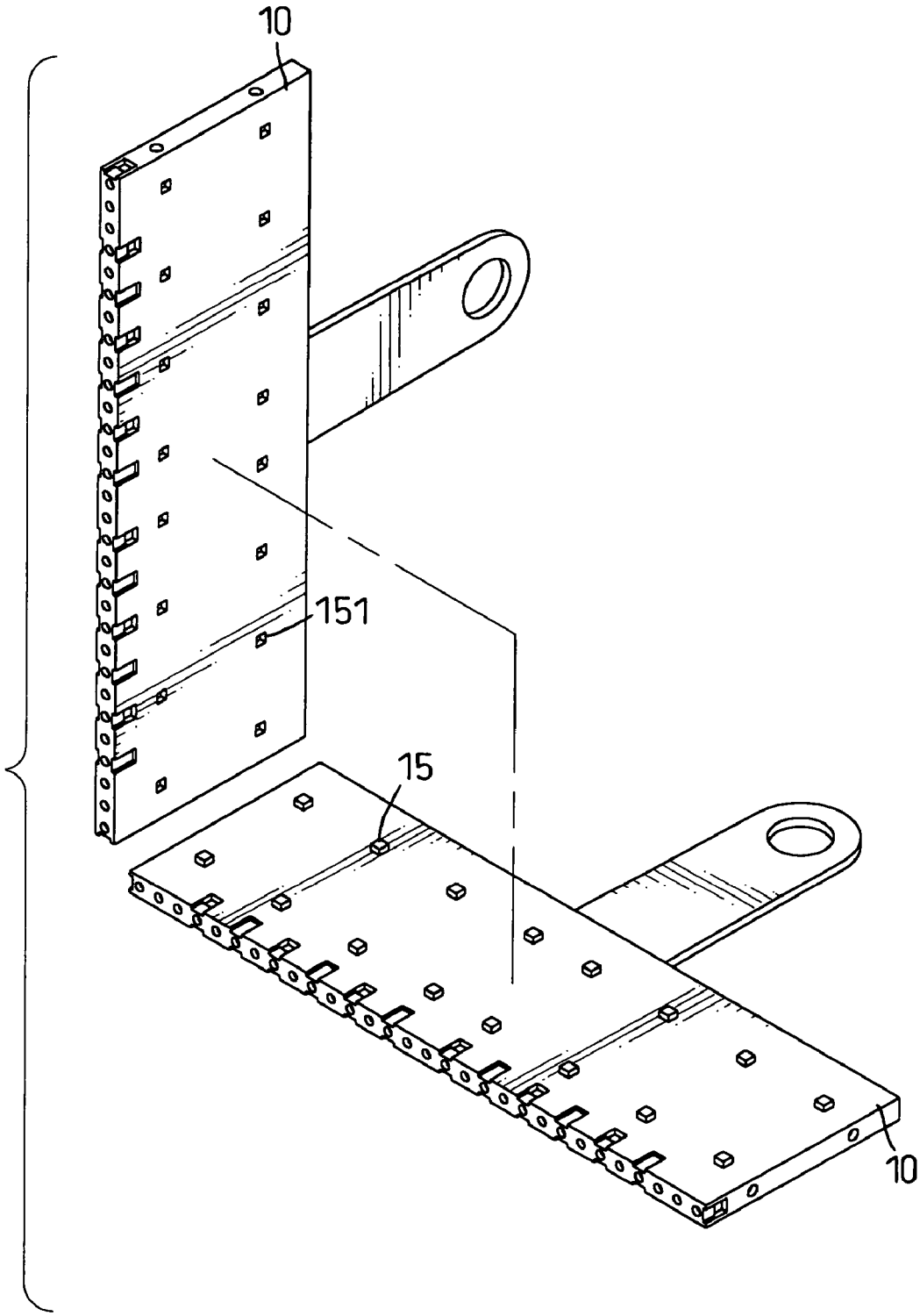
Figure 7:
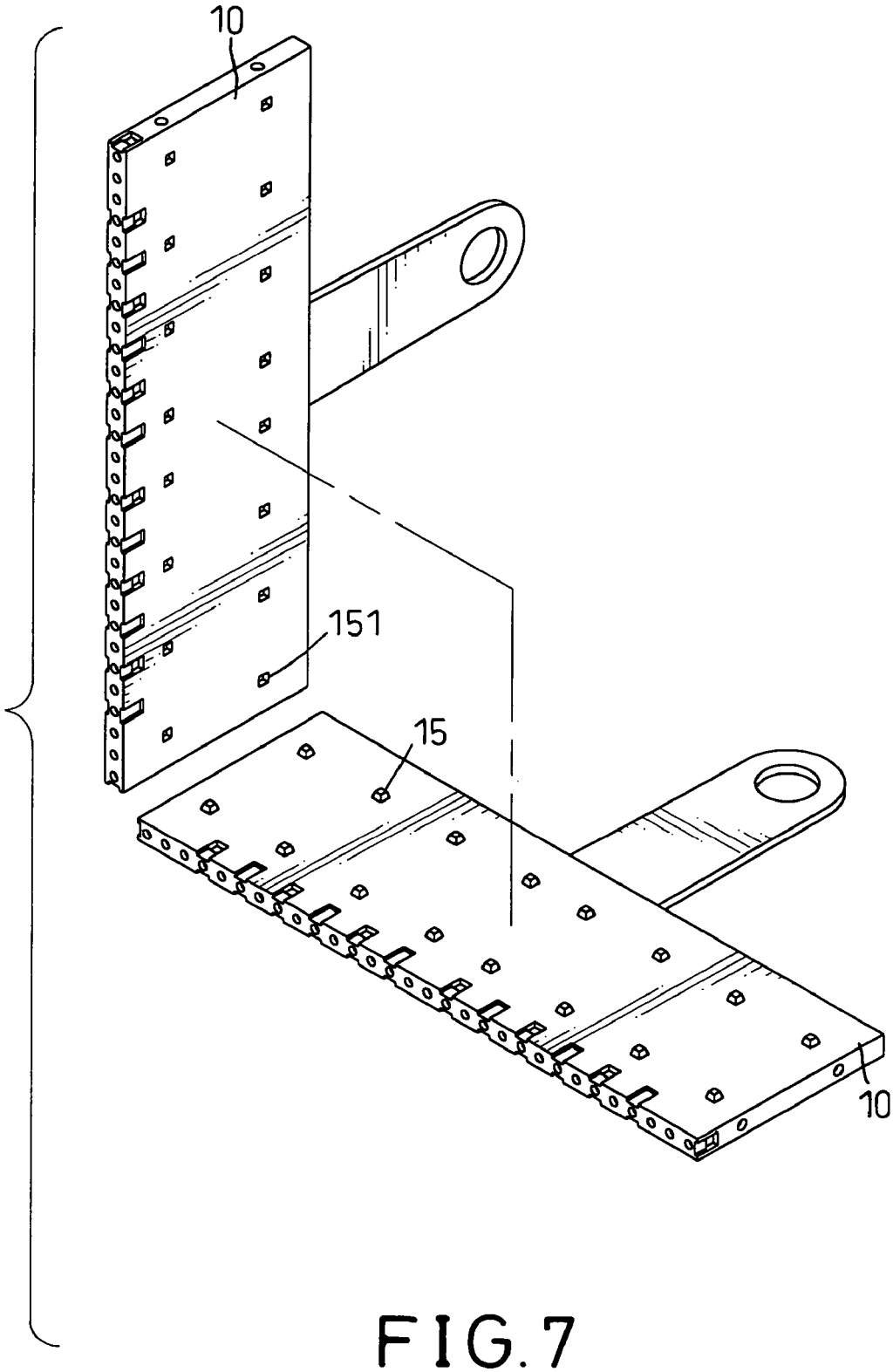

With reference to FIGS. 2 and 3 and still using FIG. 1 for reference, each display unit (10) has an extension (111) extending from a rear side face of the display unit (10) and having a through hole (112) defined close to a free end of the extension (111), light holes (12) defined in a front face of the display unit (10), passages (121) defined inside the display unit (10) to respectively correspond to and communicate with one of the light holes (12), first mating cutouts (13) oppositely and alternately defined in the top face and a bottom face of the display unit (10), second mating cutouts (14) oppositely and alternately defined in the top face and the bottom face of the display unit (10) such that each first mating cutout (13) on the top face (the bottom face as well) of the display unit (10) is alternate to each second mating cutout (14), first bosses (15) formed on the top face of the display unit (10), first grooves (151) defined in the bottom face of the display unit (10), second bosses (16) formed on a side face of the display unit (10) and second grooves (161) defined in a side face of the display unit (10) opposite to the second bosses (161). First engaging holes (17) are defined in the side face of the display unit (10) and second engaging holes (171) are defined in the side face of the display unit (10) opposite to the first engaging holes (17).

The conducting board (30) has multiple claws (32) formed on and extending out of side faces of the conducting board (30) to correspond to the first and second mating cutouts (13,14) and multiple light emitting holes (31) defined in a front face of the conducting board (30). It is noted that each claw (32) is aligned with a corresponding one of the first (or second) mating cutouts (13) (or 14).

With reference to FIGS. 4–7, it is noted that the each group of the bosses (15) on the top face of the display unit (10) may have different shapes such as cylindrical, square, conical or pyramidal.

Figure 8:
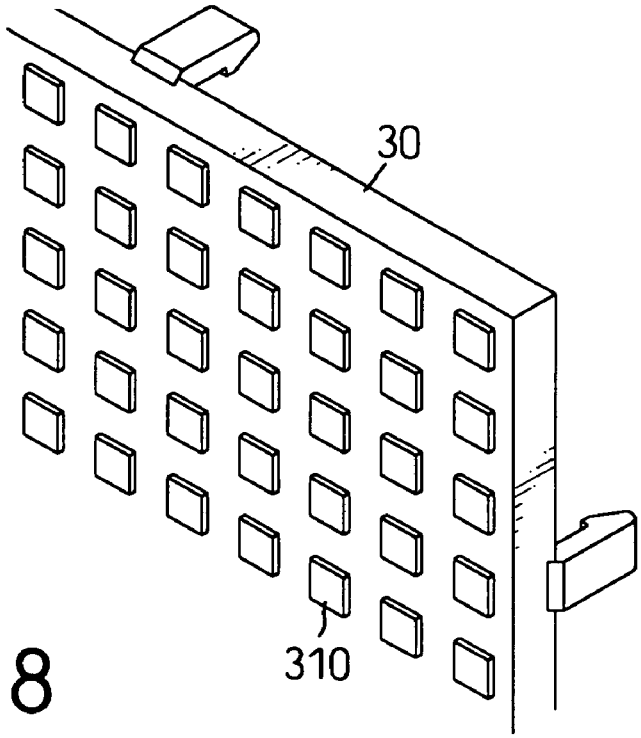
FIGS. 8–9 are schematic perspective views showing different embodiments of the light poles formed on a conducting board.
Figure 9:
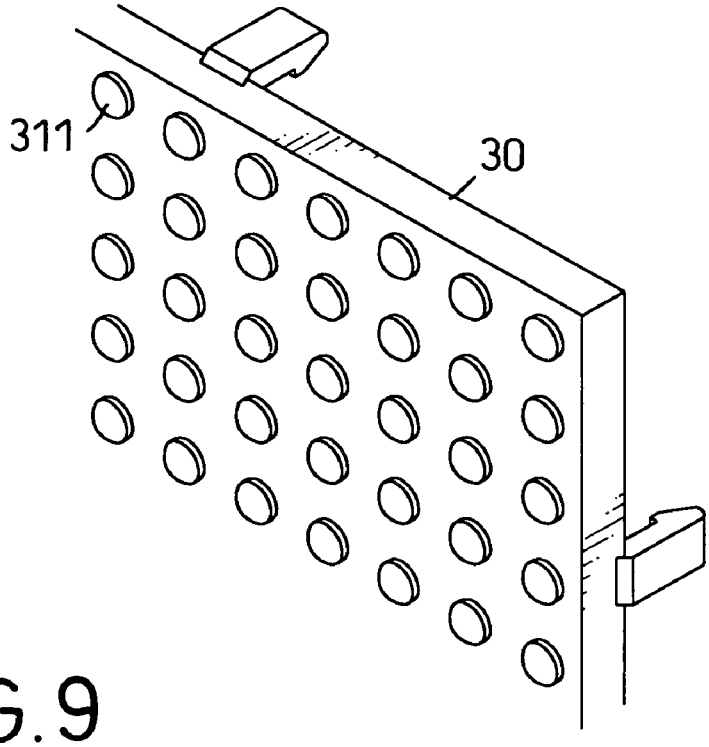

With reference to FIGS. 8 and 9, it is noted that the light emitting holes (31) may have square or cylindrical shapes but not a mixture thereof.

Figure 10:
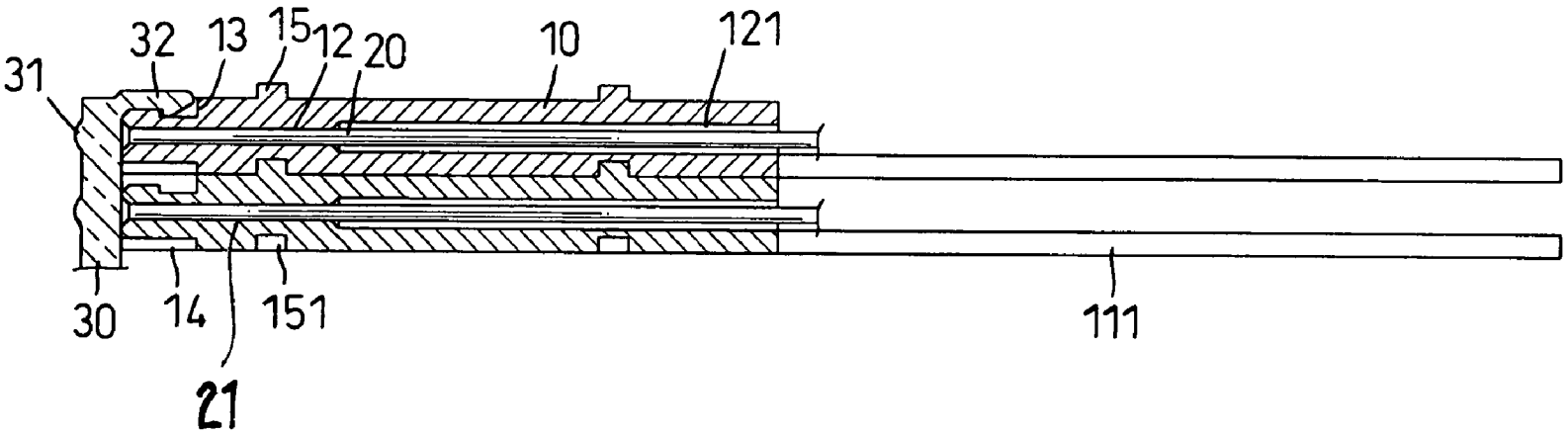
FIG. 10 is a schematic cross sectional view showing the combination of multiple longitudinally adjacent display units and the conducting board.

With reference to FIG. 10, when multiple display units (10) are to be assembled, the first bosses (15) are inserted into the first grooves (151) so that each display unit (10) is securely seated on top of one another. Optical fibers (20) are inserted into the passages (121) and filaments (21) of the optical fibers (20) are received in the light holes (12). Then the light from the filaments (21) is able to emit from the light emitting holes (31). Further, the claws (32) of the conducting board (30) are able to be received in the first mating cutouts (13) or the second mating cutouts (14).

Figure 12:
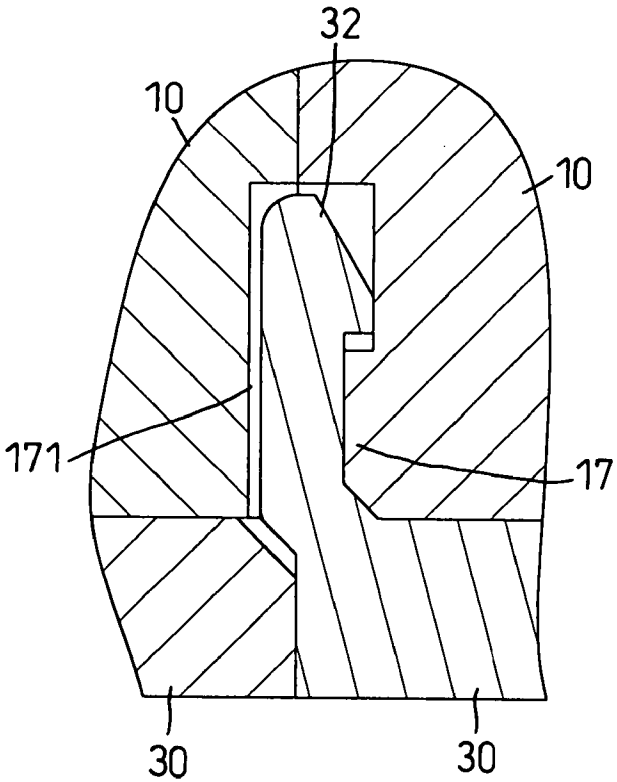
FIGS. 11 and 12 are schematic cross sectional views showing the combination between two laterally adjacent display units.
Figure 11:
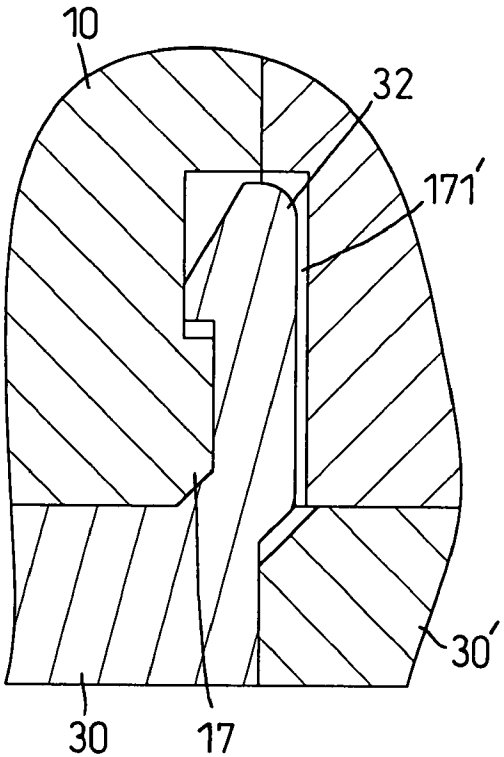

With reference to FIGS. 11 and 12, when the display unit (10) is to be extended in width instead of height (thickness), the first engaging holes (17) from one display unit (10) are combined with the second engaging holes (171) of an adjacent display unit (10) to form clamping spaces such that the claws (32) extending from the side faces of the conducting board (30) are able to be extended into the clamping spaces and thus securely combine two lateral display units (10).

Figure 13:
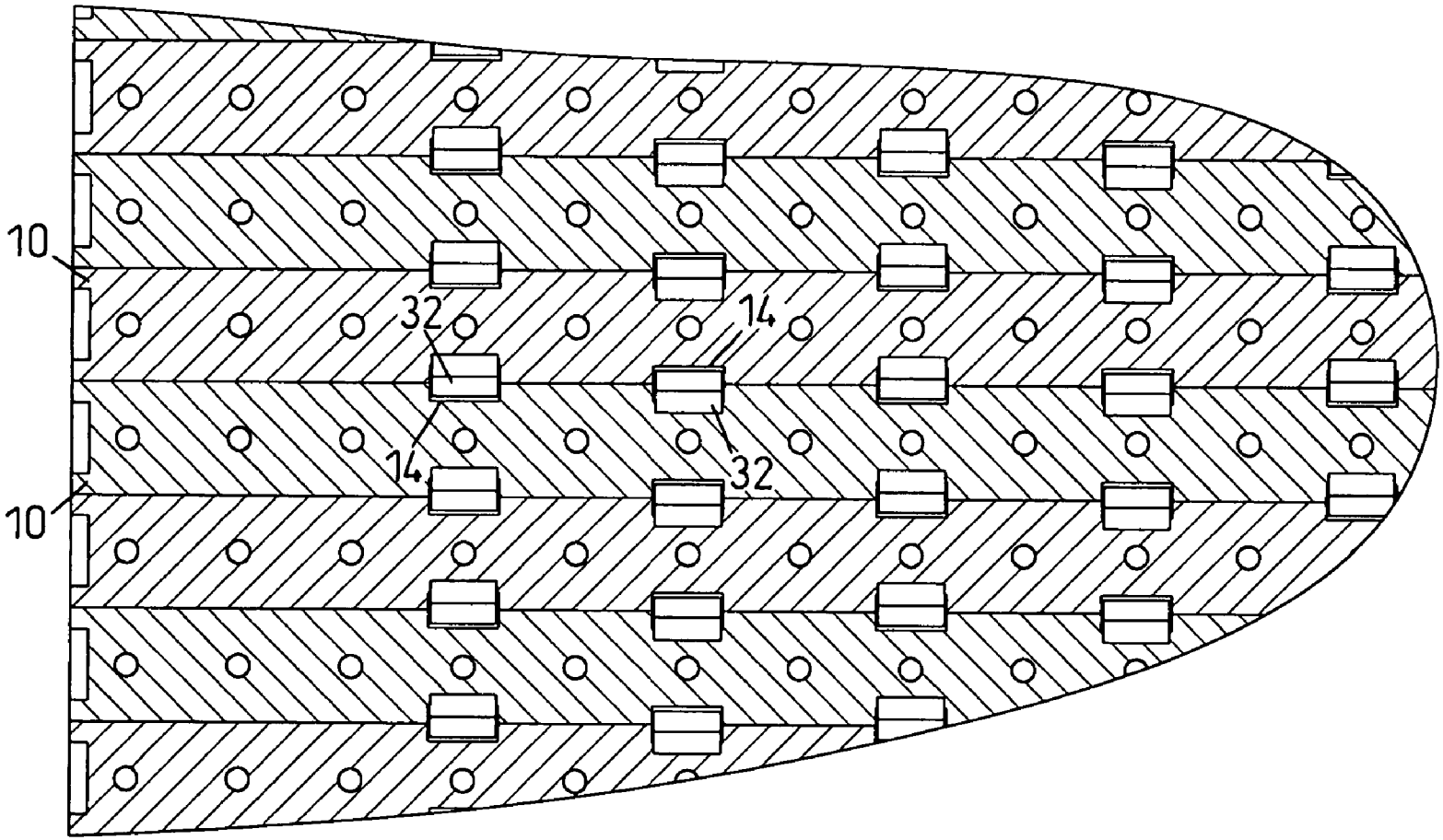
FIG. 13 is a top plan view showing the combination between two adjacent display units.

With reference to FIG. 13, it is noted that when multiple display units (10) are overlapped with one another, the claws (32) from the top face of the conducting board (30) are received in the first mating cutouts (13) of the very top display unit (10) and the claws (32) from the bottom face of the conducting board (30) are received in the second mating cutouts (14) of the very bottom display unit (10) due to the alternate arrangement between the first mating cutouts (13) and the second mating cutouts (14).

Figure 14:
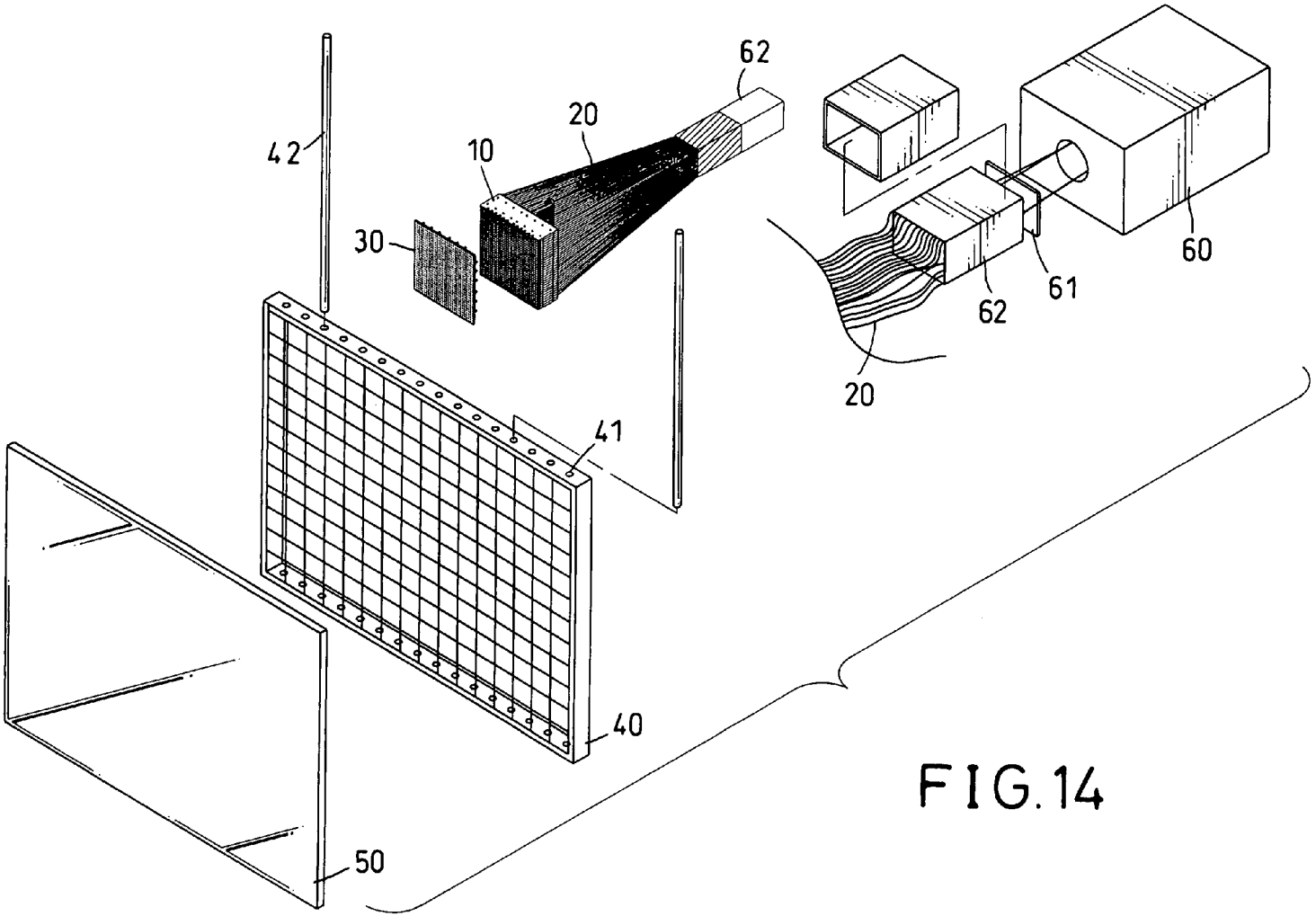
FIG. 14 is an exploded perspective view showing the application of the optical display of the present invention.

With reference to FIG. 14, when the optical display of the present invention is in application, the dimension of the optical display may be various according to requirements. Therefore, after the dimension of the optical display is determined, the assembled optical display is received in a frame (40) having holes (41) defined in side faces of the frame (40) to correspond to the through holes (112) of the extensions (111) of the display units (10) so that positioning rods (42) are able to extend into the aligned holes (41) and through holes (112) to position the display units (10) inside the frame (40). A screen (50) is provided to one side of the frame (40) to form a complete displaying screen. After all the optical fibers (20) are secured in the display units (10), free ends of the optical fibers (20) are combined to form a clustered end (62). A heat insulating board (61) is sandwiched between the clustered end (62) and a projector (60).

Therefore, when light of different colors comes from the projector (60), the lights pass through the optical fibers (20) and then emit from the light emitting holes (31) of the conducting board (30). Eventually, the lights emit from the screen (50).

Because each light source (the filaments (21)) is close to each other, the resolution of the screen (50) is high. Furthermore, due to the overlapping structure of the optical display, the manufacture of the display is easy and the application of the display is much more flexible than the prior arts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An optical display having multiple display units overlapped on top of one another, each display unit comprising:

light holes defined in a front face of the display unit for emission of light;

multiple first bosses formed on a top face of the display unit; and multiple first grooves defined in a bottom face of the display unit such that two adjacent display units are able to be combined with one another via the extension of the first bosses from one display unit into the first grooves of the other display unit.

2. The optical display as claimed in claim 1 further comprising a conducting board having light emitting holes corresponding to the light holes such that the light is able to emit through the light holes and the light emitting holes.

3. The optical display as claimed in claim 2, wherein the display unit further has multiple first mating cutouts and second mating cutouts alternately defined in side faces of the display unit; and the conducting board has multiple claws formed on side faces of the conducting board to alternately correspond to the first mating cutouts and the second mating cutouts.

4. The optical display as claimed in claim 2, wherein the display unit further has second bosses and second grooves formed on opposite side faces of the display units so that two laterally adjacent display units are able to be combined via extension of the second bosses from one display unit into the second grooves of the other display unit.

5. The optical display as claimed in claim 1, wherein the display unit further comprises first engaging holes and second engaging holes defined in the opposite side faces of the display unit so that when two laterally adjacent display units are combined, extension of the claws from opposite side faces of the conducting board into clamping spaces defined by combination of the first engaging holes from one display unit and the second engaging holes from the other display unit is able to secure engagement between two laterally adjacent display units.

6. The optical display as claimed in claim 1, wherein the display unit further has an extension extending from a rear face of the display unit and having a through hole defined through the extension.

7. The optical display as claimed in claim 6 further comprising a frame having multiple holes defined to correspond to and aligned with the through holes of the extensions such that positioning rods are able to extend into the aligned holes and through holes to secure the display units in the frame; and a screen applied to a side face of the frame for projecting lights from the frame, wherein the display unit further comprises a passage in communication with a light hole inside the display unit to receive therein an optical fiber and a filament of the optical fiber respectively, wherein the display unit further has a clustered end of the optical fibers which are in alignment with a projector such that lights are able to pass through the clustered end, the conducting board, the frame and the screen.

* * * * *